US008125334B1

(12) United States Patent
Loyal et al.

(10) Patent No.: US 8,125,334 B1
(45) Date of Patent: Feb. 28, 2012

(54) VISUAL EVENT DETECTION SYSTEM

(75) Inventors: Brian Jacob Loyal, Weldon Spring, MO (US); Michael S. Thielker, Hazelwood, MO (US); Andrew Michael Rittgers, Allen, TX (US)

(73) Assignee: The Boeing Company, Chicago, IL (US)

( * ) Notice: Subject to any disclaimer, the term of this patent is extended or adjusted under 35 U.S.C. 154(b) by 126 days.

(21) Appl. No.: 12/640,555

(22) Filed: Dec. 17, 2009

(51) Int. Cl.
*G08B 21/00* (2006.01)

(52) U.S. Cl. ... 340/540; 340/524; 340/541; 340/539.25; 348/143

(58) Field of Classification Search ..... 340/540, 340/541, 500, 506, 517, 521, 522, 524, 539.2, 340/539.22, 539.26, 565, 539.25; 348/143, 348/507.085, 135
See application file for complete search history.

(56) References Cited

U.S. PATENT DOCUMENTS 7,023,913 B1 * 4/2006 Monroe ..... 375/240.01
7,952,609 B2 * 5/2011 Simerly et al. ..... 348/143
2006/0109113 A1 * 5/2006 Reyes et al. ..... 340/541
2007/0132844 A1 * 6/2007 Katz ..... 348/140
2008/0084473 A1 * 4/2008 Romanowich ..... 348/135
(Continued)

OTHER PUBLICATIONS

"Intelligence & Information Warfare—Multi-User Panoramic Synthetic Vision System (MPSVS)". pp. 1-2, retrieved Oct. 15, 2009 http://www.iiw.itt.com/products/mpsys/prodMPSVS.shtml.

(Continued)

*Primary Examiner* — Toan N Pham
(74) *Attorney, Agent, or Firm* — Yee & Associates, P.C.

(57) ABSTRACT

A method for detecting an event. A number of video data streams is generated for an environment around a platform. The number of video data streams is received from a video camera system associated with platform. The event is detected at the platform using a sensor system. Information is generated about a location of the event in response to detecting the event. A portion of the number of video data streams is identified by a computer system corresponding to a time and a location of the event using the information about the location of the event. The portion of the number of video data streams is presented by the computer system.

26 Claims, 8 Drawing Sheets

U.S. PATENT DOCUMENTS

2010/0245582 A1* 9/2010 Harel ..... 348/159

OTHER PUBLICATIONS

"Immersive Media technology & services—patented and proven", 1 page, retrieved Dec. 8, 2009 http://www.immersivemedia.com/.

"Point Grey Products", pp. 1, retrieved Oct. 15, 2009 http://www.ptgrey.com/products/ladybug3/index.asp.

"FullSight IP 360 Camera", pp. 1-3, retrieved Oct. 15, 2009 http://www.sentry360.com/products/fullsightip/.

* cited by examiner

VISUAL EVENT DETECTION SYSTEM

BACKGROUND INFORMATION

1. Field

The present disclosure relates generally to detecting events and, in particular, to detecting visual events. Still more particularly, the present disclosure relates to a method and apparatus for identifying the location of visual events relative to a platform.

2. Background

Detection systems may be used to identify events, such as gunshots. A detection system may detect the location of a gunshot or other weapons fire using acoustic sensors, optical sensors, and/or radiofrequency sensors. These types of systems are used by law enforcement, the military, and other users to identify the source, the direction of gunfire, and in some cases, the type of weapon used.

A detection system may include an array of microphones, a processing unit, and a user interface. The processing unit processes signals from the array of microphones. The array of microphones may be located near each other or dispersed geographically. For example, the array of microphones may be dispersed throughout a park, a street, a town, or some other suitable locations at a law enforcement agency. The user interface may receive and provide an indication of events that occurred. For example, the user interface may present a map and an address location of each gunfire event that is detected.

These types of detection systems increase the ability for law enforcement agencies to respond to these types of events. Personnel may travel to the particular locations using the information to look for the source of the gunfire.

These types of systems also may be used by the military to detect snipers or other hostile gunfire. For example, with respect to snipers, an array of microphones may be placed on a vehicle. These sensors detect and measure the muzzle blast and supersonic shockwave from a speeding bullet as it moves through the air. Each microphone picks up the sound waves at slightly different times. These signals are processed to identify the direction from which a bullet is travelling. Additionally, the processes may identify the height above the ground and how far away the shooter is.

With these types of systems, a light-emitting diode with a twelve-hour clock image is presented inside the vehicle. The system may light up in the six o'clock position if the event is detected at the six o'clock position relative to the vehicle. Further, the display also may include information about the range, elevation, and azimuth of the origination of the event.

These detection systems increase the probability of identifying the source of gunfire in both law enforcement and military settings. With these systems, the indications or information aid in identifying the source. Identifying the sniper may be difficult, depending on the conditions. The information aids the personnel. The personnel still search the location based on the information provided. For example, if the event occurred at nighttime or if dense foliage, buildings, or other objects are present, locating the shooter may be made more difficult.

Therefore, the illustrative embodiments provide a method and apparatus that takes into account one or more of the issues discussed above, as well as possibly other issues.

SUMMARY

In one illustrative embodiment, an apparatus comprises a video camera system, an event detection system, and a computer system. The video camera system is configured for association with a platform and configured to generate a number of video data streams. The event detection system is configured for association with the platform and configured to detect an event and generate information about the event. The computer system is configured to receive the number of video data streams from the video camera system. The computer system is configured to receive the information from the event detection system. The computer system is configured to identify a portion of the number of video data streams corresponding to a time and a location of the event using the information. The computer system is also configured to present the portion of the number of video data streams.

In another illustrative embodiment, a method is present for detecting an event. A number of video data streams is generated for an environment around a platform. The number of video data streams is received from a video camera system associated with the platform. The event is detected at the platform using a sensor system. Information is generated about a location of the event in response to detecting the event. A portion of the number of video data streams is identified by a computer system corresponding to a time and a location of the event using the information about the location of the event. The portion of the number of video data streams is presented by the computer system.

In yet another illustrative embodiment, a computer program product is present for detecting an event. The computer program product comprises a computer readable storage medium, and program code stored on the computer readable storage medium. Program code is present for generating a number of video data streams for an environment around a platform. The number of video data streams is received from a video camera system associated with the platform. Program code is present for detecting the event at the platform using a sensor system. Program code is also present for generating information about a location of the event in response to detecting the event. Program code is present for identifying, by a computer system, a portion of the number of video data streams corresponding to a time and the location of the event using the information about the location of the event. Program code is also present for presenting, by the computer system, the portion of the number of video data streams.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and advantages thereof, will best be understood by reference to the following detailed description of an illustrative embodiment of the present disclosure when read in conjunction with the accompanying drawings, wherein:

DETAILED DESCRIPTION

The different illustrative embodiments recognize and take into account a number of different considerations. For example, the different illustrative embodiments recognize and take into account that currently used detection systems for gunfire generate information about the location from which the gunfire originated. This location information may include, for example, the trajectory and point of fire. These detection systems may provide information such as, for example, a range, elevation, and azimuth. The different illustrative embodiments recognize and take into account that currently used systems may provide a location of the gunfire relative to a vehicle. For example, a light-emitting diode may light up on a circular display indicating the position of the source relative to the vehicle.

The different illustrative embodiments recognize and take into account that with this information, the operator of the vehicle may look for the origination point or shooter. This type of process takes time. The different illustrative embodiments recognize and take into account that by the time the operator receives the information, the shooter may have moved away from the location or gone into hiding. Thus, currently used event detection systems may not provide the information needed to locate the shooter or movement of the shooter after the event.

Thus, the different illustrative embodiments provide a method and apparatus for detecting events. In one illustrative embodiment, an apparatus comprises a video camera system, an event detection system, and a computer system. The video camera system is associated with a platform and configured to generate a number of video data streams. The event detection system also is associated with the platform and configured to detect an event and generate information about the event. The computer system is associated with the platform and configured to receive the number of video data streams from the video camera system, receive information from the event detection system, identify a portion of the number of video data streams corresponding to a time and a location of the event using the information, and present the portion of the video data stream.

Figure 1:
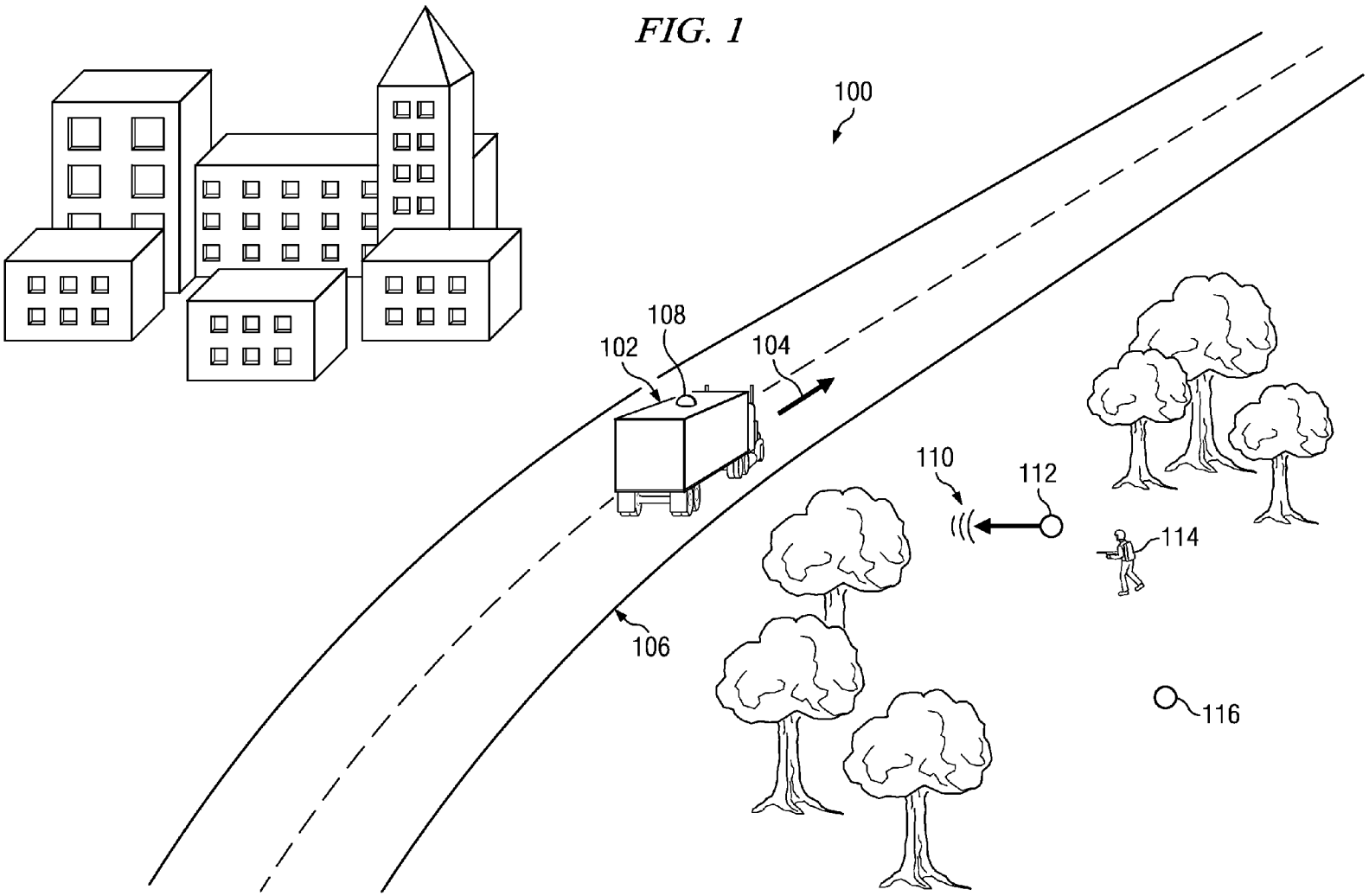
FIG. 1 is an illustration of an event detection environment in accordance with an illustrative embodiment.

Turning now to FIG. 1, an illustration of an event detection environment is depicted in accordance with an illustrative embodiment. As depicted, event detection environment 100 is an example of one implementation in which different illustrative embodiments may be employed. Event detection environment 100, in this example, includes vehicle 102. Vehicle 102 travels in the direction of path 104 on road 106.

In the illustrative examples, event detection system 108 is associated with vehicle 102. A first component may be considered to be associated with a second component by being secured to the second component, bonded to the second component, fastened to the second component, and/or connected to the second component in some other suitable manner. The first component also may be connected to the second component by using a third component. The first component also may be considered to be associated with the second component by being formed as part of and/or an extension of the second component.

In this illustrative example, path 104 is along road 106. As vehicle 102 travels along path 104, event 110 occurs at location 112. Event detection system 108 detects the event and identifies location 112.

Event detection system 108 also is configured to present a display of location 112. In these illustrative examples, the display is an actual video display from video data generated by event detection system 108. This video data is from the time and the location of event 110. This video data may be used by an operator in vehicle 102 or some other location to visually identify shooter 114 at location 112 at the time event 110 occurred. In this manner, an operator in vehicle 102 may more easily identify shooter 114.

In addition, the operator in vehicle 102 also may determine whether shooter 114 has moved or the direction of movement after the occurrence of event 110. With this information, event detection system 108 may be operated to obtain video data streams to track movement of shooter 114.

For example, shooter 114 may now be in location 116 after event 110. With the display of event 110 at location 112, the operator of vehicle 102 may see shooter 114 move to or in the direction of location 116.

In this manner, additional information may be presented to an operator of vehicle 102 or an operator at a remote location to identify the source of event 110. By correlating video data streams with the event, one or more of the different illustrative embodiments increase the speed and/or likelihood that the source of an event can be identified and located.

Figure 2:
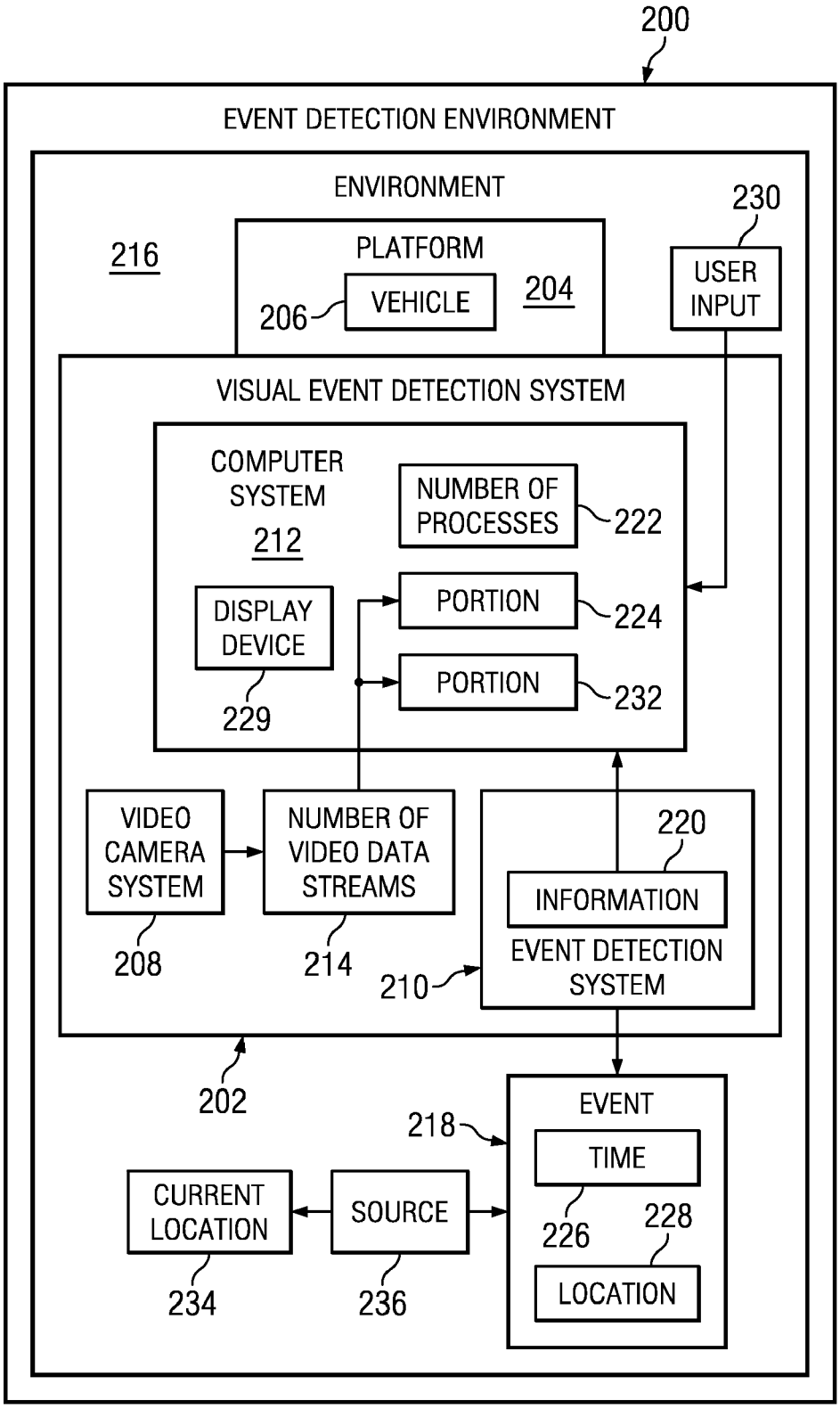
FIG. 2 is an illustration of an event detection environment in accordance with an illustrative embodiment.

With reference now to FIG. 2, an illustration of an event detection environment is depicted in accordance with an illustrative embodiment. Event detection environment 100 in FIG. 1 is an example of one implementation for event detection environment 200 in FIG. 2.

In this illustrative example, event detection environment 200 includes visual event detection system 202. As depicted, visual event detection system 202 is associated with platform 204. Platform 204 may be, for example, vehicle 206 in these illustrative examples.

Visual event detection system 202 comprises video camera system 208, event detection system 210, and computer system 212. Video camera system 208, event detection system 210, and computer system 212 are associated with platform 204 in these examples.

Video camera system 208 generates number of video data streams 214 for environment 216 around platform 204. In these illustrative examples, video camera system 208 may generate number of video data streams 214 to cover all of environment 216 around vehicle 206. For example, without limitation, number of video data streams 214 may cover 360 degrees and/or 4 pi steradians around platform 204.

Event detection system 210 is configured to detect event 218 and generate information 220 about event 218. In the different illustrative examples, event 218 may be, for example, a gunshot, an explosion, a voice, or some other suitable event.

In these illustrative examples, computer system 212 comprises a number of computers that may be in communication with each other. Computer system 212 is configured to run number of processes 222. A number of, as used herein with reference to an item, refers to one or more items. For example, number of processes 222 is one or more processes.

When running number of processes 222, computer system 212 receives number of video data streams 214 from video camera system 208. Additionally, computer system 212 receives information 220 from event detection system 210. Computer system 212 identifies portion 224 in number of video data streams 214 corresponding to time 226 and location 228 of event 218 using information 220. Computer system 212 presents portion 224 of number of video data streams 214 on display device 229 for computer system 212.

In these illustrative examples, portion 224 may be contiguous video data in number of video data streams 214. In other illustrative embodiments, portion 224 may be made up of a number of different parts and may be non-contiguous in number of video data streams 214.

Further, in response to user input 230, computer system 212 may shift the presentation of portion 224 to portion 232 in number of video data streams 214. Portion 232 may correspond to current location 234 in which source 236 of event 218 may be seen moving from location 228. Source 236 is the object causing event 218. Source 236 may be at least one of, for example, without limitation, a number of persons, a gun, a vehicle, or some other suitable object. In this manner, the user may identify current location 234 for source 236 of event 218.

Also, in response to movement of platform 204, portion 232 may change to maintain a display of current location 234. In other words, number of processes 222 may change video data streams in number of video data streams 214 to select portion 232 in response to movement of platform 204. In this manner, a visual presentation of event 218 may be made. This presentation of portion 224 and portion 232 may increase a likelihood of identifying and locating source 236 of event 218. Further, computer system 212 running number of processes 222 is configured to shift presentation of portion 232 to portion 224 in number of video data streams 214 taking into account movement of source 236 of event 218. Portion 232 and portion 224 include source 236 in these illustrative examples.

Figure 3:
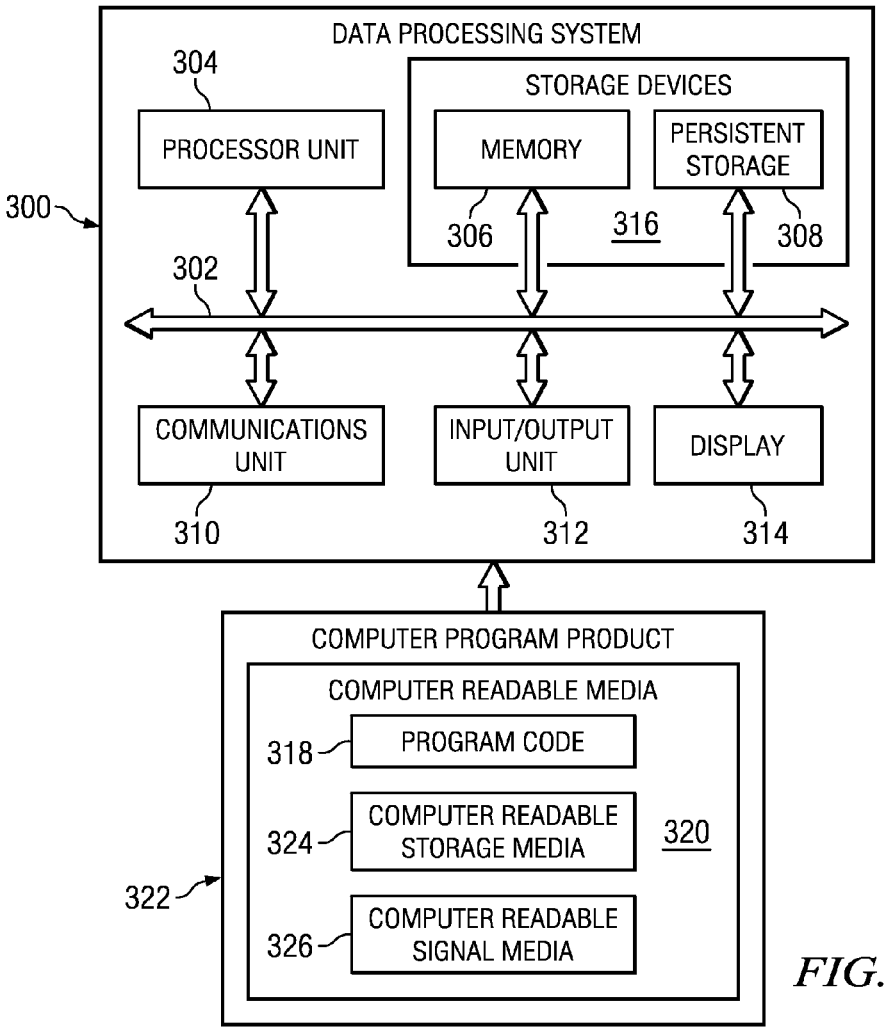
FIG. 3 is an illustration of a data processing system in accordance with an illustrative embodiment.

Turning now to FIG. 3, an illustration of a data processing system is depicted in accordance with an illustrative embodiment. Data processing system 300 may be used to implement computer system 212. In this illustrative example, data processing system 300 includes communications fabric 302, which provides communications between processor unit 304, memory 306, persistent storage 308, communications unit 310, input/output (I/O) unit 312, and display 314.

Processor unit 304 serves to execute instructions for software that may be loaded into memory 306. Processor unit 304 may be a set of one or more processors or may be a multiprocessor core, depending on the particular implementation. Further, processor unit 304 may be implemented using one or more heterogeneous processor systems, in which a main processor is present with secondary processors on a single chip. As another illustrative example, processor unit 304 may be a symmetric multi-processor system containing multiple processors of the same type.

Memory 306 and persistent storage 308 are examples of storage devices 316. A storage device is any piece of hardware that is capable of storing information, such as, for example, without limitation, data, program code in functional form, and/or other suitable information either on a temporary basis and/or a permanent basis. Memory 306, in these examples, may be, for example, a random access memory or any other suitable volatile or non-volatile storage device. Persistent storage 308 may take various forms, depending on the particular implementation. For example, persistent storage 308 may contain one or more components or devices. For example, persistent storage 308 may be a hard drive, a flash memory, a rewritable optical disk, a rewritable magnetic tape, or some combination of the above. The media used by persistent storage 308 may be removable. For example, a removable hard drive may be used for persistent storage 308.

Communications unit 310, in these examples, provides for communication with other data processing systems or devices. In these examples, communications unit 310 is a network interface card. Communications unit 310 may provide communications through the use of either or both physical and wireless communications links.

Input/output unit 312 allows for the input and output of data with other devices that may be connected to data processing system 300. For example, input/output unit 312 may provide a connection for user input through a keyboard, a mouse, and/or some other suitable input device. Further, input/output unit 312 may send output to a printer. Display 314 provides a mechanism to display information to a user.

Instructions for the operating system, applications, and/or programs may be located in storage devices 316, which are in communication with processor unit 304 through communications fabric 302. These instructions may be for processes, such as number of processes 222, running on computer system 212 in FIG. 2. In these illustrative examples, the instructions are in a functional form on persistent storage 308. These instructions may be loaded into memory 306 for execution by processor unit 304. The processes of the different embodiments may be performed by processor unit 304 using computer implemented instructions, which may be located in a memory, such as memory 306.

These instructions are referred to as program code, computer usable program code, or computer readable program code that may be read and executed by a processor in processor unit 304. The program code, in the different embodiments, may be embodied on different physical or computer readable storage media, such as memory 306 or persistent storage 308.

Program code 318 is located in a functional form on computer readable media 320 that is selectively removable and may be loaded onto or transferred to data processing system 300 for execution by processor unit 304. Program code 318 and computer readable media 320 form computer program product 322.

In one example, computer readable media 320 may be computer readable storage media 324 or computer readable signal media 326. Computer readable storage media 324 may include, for example, an optical or magnetic disk that is inserted or placed into a drive or other device that is part of persistent storage 308 for transfer onto a storage device, such as a hard drive, that is part of persistent storage 308.

Computer readable storage media 324 also may take the form of a persistent storage, such as a hard drive, a thumb drive, or a flash memory that is connected to data processing system 300. In some instances, computer readable storage media 324 may not be removable from data processing system 300.

Alternatively, program code 318 may be transferred to data processing system 300 using computer readable signal media 326. Computer readable signal media 326 may be, for example, a propagated data signal containing program code 318. For example, computer readable signal media 326 may be an electromagnetic signal, an optical signal, and/or any other suitable type of signal. These signals may be transmitted over communications links, such as wireless communications links, an optical fiber cable, a coaxial cable, a wire, and/or any other suitable type of communications link. In other words, the communications link and/or the connection may be physical or wireless in the illustrative examples.

In some illustrative embodiments, program code 318 may be downloaded over a network to persistent storage 308 from another device or data processing system through computer readable signal media 326 for use within data processing system 300. For instance, program code stored in a computer readable storage media in a server data processing system may be downloaded over a network from the server to data processing system 300. The data processing system providing program code 318 may be a server computer, a client computer, or some other device capable of storing and transmitting program code 318.

The different components illustrated for data processing system 300 are not meant to provide architectural limitations to the manner in which different embodiments may be implemented. The different illustrative embodiments may be implemented in a data processing system including components in addition to or in place of those illustrated for data processing system 300. Other components shown in FIG. 3 can be varied from the illustrative examples shown. The different embodiments may be implemented using any hardware device or system capable of executing program code. As one example, data processing system 300 may include organic components integrated with inorganic components and/or may be comprised entirely of organic components excluding a human being. For example, a storage device may be comprised of an organic semiconductor.

As another example, a storage device in data processing system 300 is any hardware apparatus that may store data. Memory 306, persistent storage 308, and computer readable media 320 are examples of storage devices in a tangible form.

In another example, a bus system may be used to implement communications fabric 302 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 306 or a cache such as found in an interface and memory controller hub that may be present in communications fabric 302.

Figure 4:
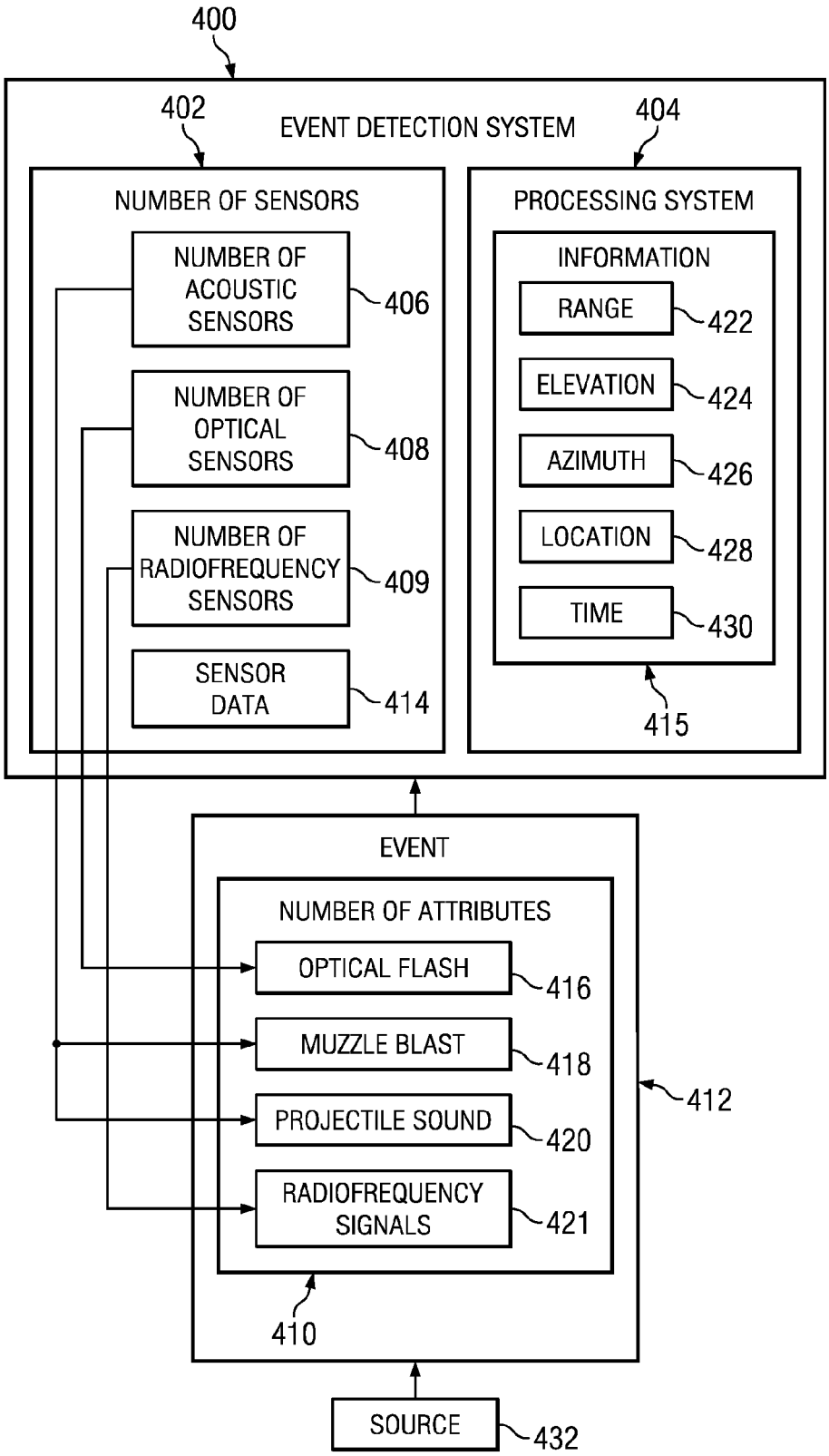
FIG. 4 is an illustration of an event detection system in accordance with an illustrative embodiment.

With reference now to FIG. 4, an illustration of an event detection system is depicted in accordance with an illustrative embodiment. Event detection system 400 is an example of one implementation for event detection system 210 in FIG. 2.

As illustrated, event detection system 400 may comprise number of sensors 402 and processing system 404. In some illustrative embodiments, processing system 404 may be, for example, without limitation, data processing system 300 in FIG. 3. In yet other illustrative embodiments, processing system 404 may be a simpler version of data processing system 300 and may include processor unit 304 and memory 306 in FIG. 3 without other components.

In these illustrative examples, number of sensors 402 may comprise at least one of number of acoustic sensors 406, number of optical sensors 408, and number of radiofrequency sensors 409. Number of acoustic sensors 406 may be, for example, a number of microphones. Number of optical sensors 408 may be, for example, visible light or infrared sensors.

As another example, in some advantageous embodiments, number of sensors 402 also may include other types of sensors in addition to or in place of number of acoustic sensors 406 and number of optical sensors 408. For example, number of sensors 402 also may include radiofrequency sensors and/or other suitable types of sensors in addition to or in place of number of acoustic sensors 406 and number of optical sensors 408.

Number of sensors 402 may detect number of attributes 410 for event 412 to generate sensor data 414. Sensor data 414 may take the form of electrical signals in these examples.

For example, without limitation, number of attributes 410 may include at least one of optical flash 416, muzzle blast 418, projectile sound 420, and radiofrequency signals 421. Optical flash 416 may be a light or other flash that may occur when an explosive charge is ignited with a projectile from the chamber of a weapon. Muzzle blast 418 may be the sound that occurs when the explosive charge is ignited for the projectile. Projectile sound 420 is the sound that occurs as the projectile moves through the air.

In these illustrative examples, number of acoustic sensors 406 may be used to detect muzzle blast 418 and projectile sound 420. Number of optical sensors 408 may be used to detect optical flash 416. Number of radiofrequency sensors 409 may be used to detect radiofrequency signals 421 in these depicted examples.

In the different illustrative embodiments, when event 412 is detected, processing system 404 receives sensor data 414 and generates information 415 from sensor data 414. Information 415 may include, for example, without limitation, at least one of range 422, elevation 424, azimuth 426, location 428, and time 430.

Range 422 may be a distance between source 432 of event 412 and event detection system 400. Elevation 424 may be an angle between a horizontal plane and a direction to source 432. Azimuth 426 is an angle with respect to an axis through event detection system 400 and a line to source 432. Location 428 may be a coordinate and latitude location. Location 428 may be generated by processing system 404 using range 422, elevation 424, and azimuth 426. Time 430 is the time at which event 412 is detected by number of sensors 402.

In yet other illustrative embodiments, event detection system 400 may not include processing system 404. Instead, number of sensors 402 may send sensor data 414 to a computer system, such as computer system 212 in FIG. 2, for processing.

Figure 5:
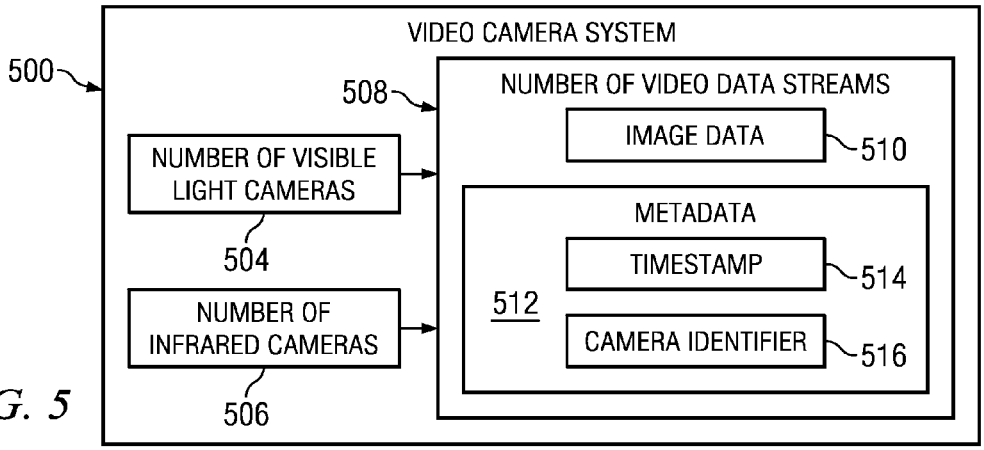
FIG. 5 is an illustration of a video camera system in accordance with an illustrative embodiment.

With reference now to FIG. 5, an illustration of a video camera system is depicted in accordance with an illustrative embodiment. In this illustrative example, video camera system 500 is an example of one implementation for video camera system 208 in FIG. 2.

As depicted, video camera system 500 includes at least one of number of visible light cameras 504, number of infrared cameras 506, and/or other suitable types of cameras. Number of visible light cameras 504 detects light in wavelengths from about 380 nanometers to about 450 nanometers. Number of infrared cameras 506 detects light having a wavelength from about 400 nanometers to about 15 microns. Of course, other wavelengths of light may be detected using other types of video cameras.

In these illustrative examples, video camera system 500 generates number of video data streams 508. Number of video data streams 508 may include image data 510 and metadata 512. Metadata 512 is used to describe image data 510. Metadata 512 may include, for example, without limitation, timestamp 514, camera identifier 516, and/or other suitable information.

Of course, in some illustrative embodiments, video camera system 500 may only generate image data 510. Metadata 512 may be added during later processing of number of video data streams 508. In another illustrative embodiment, only some information is present in metadata 512. For example, metadata 512 may only include timestamp 514. Camera identifier 516 may be added by a computer system receiving number of video data streams 508. Additionally, video camera system 500 may include other types of video cameras in addition to or in place of the ones depicted in these examples. For example, without limitation, the video cameras may be stereo cameras or some other suitable type of video cameras.

Figure 6:
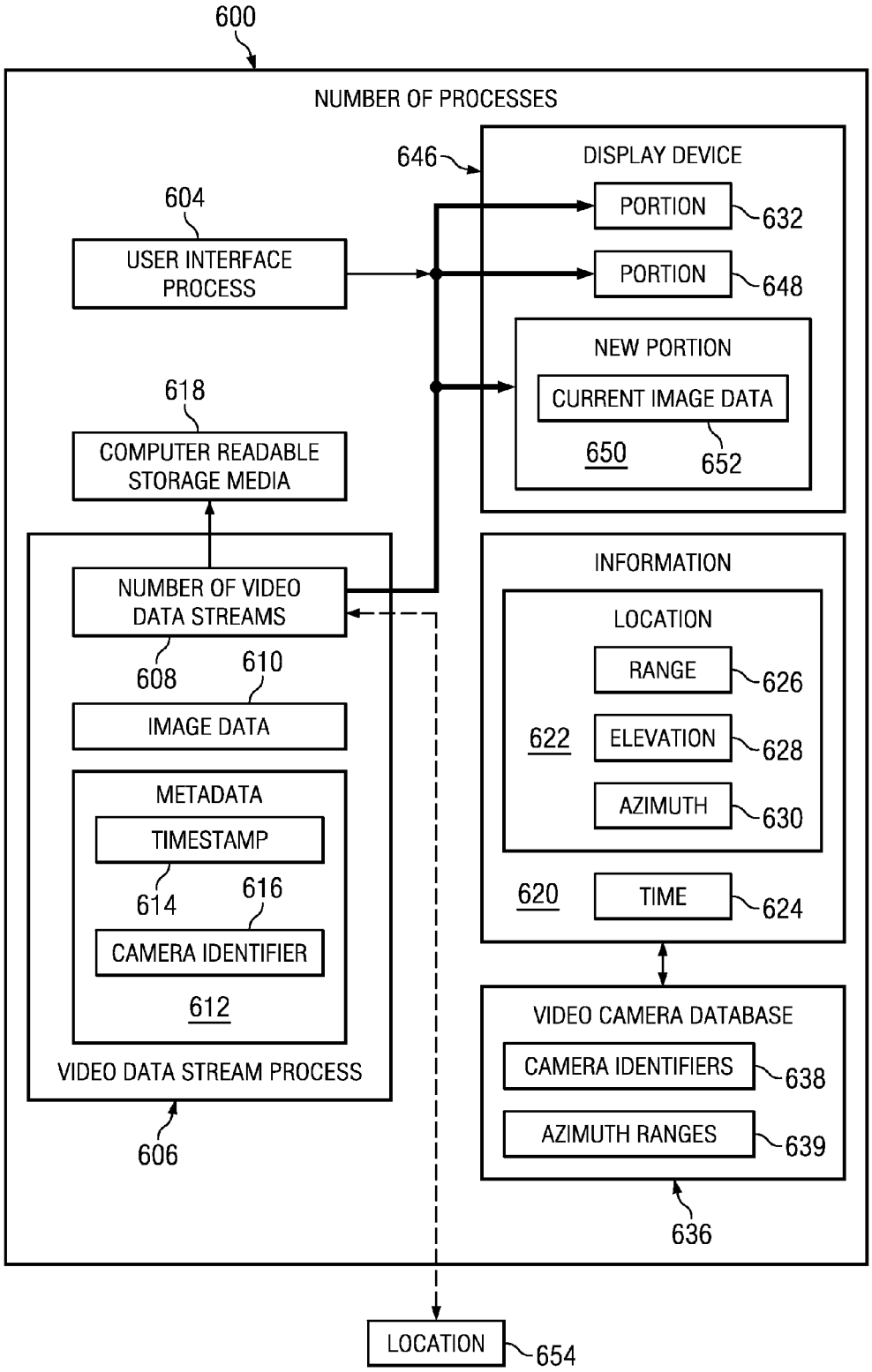
FIG. 6 is an illustration of data flow in detecting events in accordance with an illustrative embodiment.

With reference now to FIG. 6, an illustration of data flow in detecting events is depicted in accordance with an illustrative embodiment. In this illustrative example, number of processes 600 is an example of one implementation for number of processes 222 in FIG. 2. In these illustrative examples, number of processes 600 includes user interface process 604 and video data stream process 606. User interface process 604 may provide interaction with a user. Video data stream process 606 processes number of video data streams 608.

In this depicted example, number of processes 600 receives number of video data streams 608. In these examples, number of video data streams 608 is received from video camera system 500 in FIG. 5. Number of video data streams 608 includes image data 610 and metadata 612. Metadata 612 may include, for example, at least one of timestamp 614, camera identifier 616, and/or other suitable types of information. Number of video data streams 608 is stored on computer readable storage media 618 in these examples.

When an event occurs, number of processes 600 receives information 620 from event detection system 400 in FIG. 4 in these illustrative examples. Information 620 comprises location 622 and time 624. Location 622 may take a number of different forms. For example, location 622 may include range 626, elevation 628, and azimuth 630. With information 620, number of processes 600 identifies portion 632 in number of video data streams 608. Portion 632 may be identified using time 624 to identify portion 632 from timestamp 614 within number of video data streams 608. Portion 632 may include image data 610 having timestamp 614 within some range before and/or after time 624.

Additionally, portion 632 also may be identified using location 622. Camera identifier 616 and information 620 may be used to identify portion 632.

For example, in these illustrative examples, video camera database 636 may include camera identifiers 638 and azimuth ranges 639. Each video camera in video camera system 500 in FIG. 5 is associated with an identifier within camera identifiers 638. As a result, when azimuth 630 is known, azimuth 630 may be compared with azimuth ranges 639 to obtain camera identifier 616 from camera identifiers 638. Camera identifiers 638 may be used to identify a video data stream within number of video data streams 608 using camera identifier 616 in metadata 612.

When portion 632 is identified, user interface process 604 may present portion 632 on display device 646. In this manner, an operator may view portion 632. By viewing portion 632, the operator may identify the source of the event.

Further, through user interface process 604, the operator also may change the view presented on display device 646 to view portion 648. Portion 648 may be, for example, a portion in the direction of movement identified for the source.

Further, in addition to presenting portion 648 on display device 646, video data stream process 606 also may continue to identify new portion 650 from number of video data streams 608. New portion 650 may be current image data 652 in number of video data streams 608. Current image data 652 also may be referred to as real time image data. Current image data 652 is part of image data 610 as it is received in number of video data streams 608 from video camera system 500 in FIG. 5. In other words, current image data 652 is processed as soon as it is received without any intentional delays. In other words, current image data 652 may not be placed into a storage device, such as a hard disk drive, for later processing.

New portion 650 may continue to include image data 610 for location 622. New portion 650 may include image data 610 from other video cameras other than the video camera generating portion 632.

This change in video cameras may occur if the platform is moving or has moved since portion 632 was identified. Location 654 may be identified in response to user input selecting portion 648. As a result, video data stream process 606 identifies the camera corresponding to the azimuth for portion 648. That azimuth is used to identify new portion 650.

Further, as the vehicle moves, the azimuth changes, and video data stream process 606 takes into account this change to select new portion 650 from the appropriate video data stream in number of video data streams 608. In other words, as a platform moves, the video data stream generated by one camera may no longer include location 654. As a result, the video data stream for the new camera covering location 654 is used.

Also, in these illustrative examples, portion 632 also may be selected based on elevation 628. Portion 632 may only include a portion of image data 610 within some range of elevation 628. Further, video data stream process 606 also may magnify or zoom into location 622.

The illustration of event detection environment 200 in FIG. 2 and the different components for visual event detection system 202 in FIG. 2 and in FIGS. 3-6 are not meant to imply physical or architectural limitations to the manner in which different illustrative embodiments may be implemented. Other components in addition to and/or in place of the ones illustrated may be used. Some components may be unnecessary in some illustrative embodiments. Also, the blocks are presented to illustrate some functional components. One or more of these blocks may be combined and/or divided into different blocks when implemented in different illustrative embodiments.

For example, in the different illustrative embodiments, visual event detection system 202 may detect additional events in addition to event 218 occurring at or substantially the same time as event 218. In still other illustrative embodiments, number of sensors 402 may include sensors located in other locations in addition to those in vehicle 206. For example, number of sensors 402 may also be located in environment 216 around vehicle 206.

Figure 7:
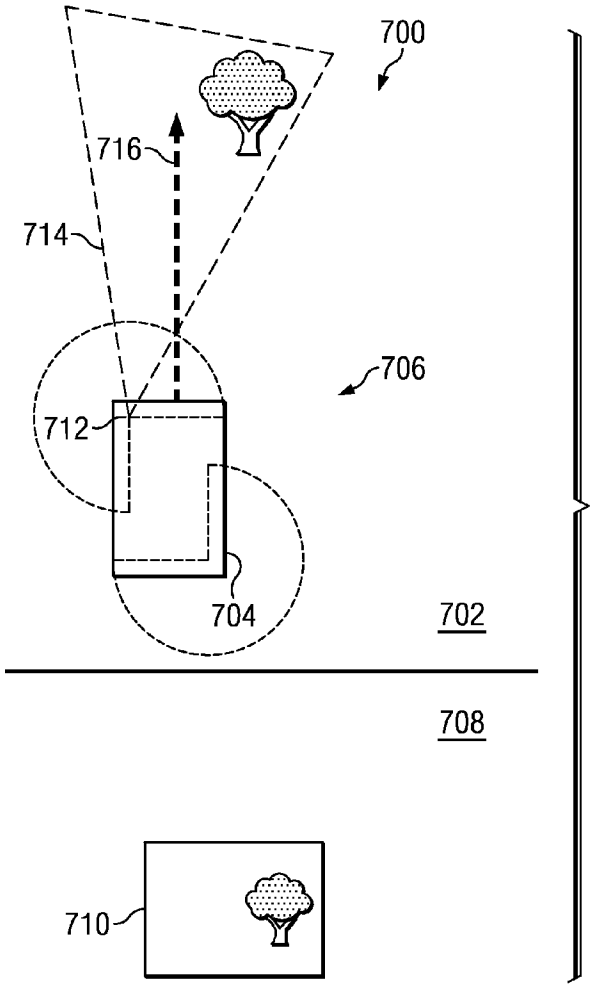

With reference now to FIGS. 7-10, illustrations of a presentation of information about events are depicted in accordance with an illustrative embodiment. In FIG. 7, user interface 700 is an example of a user interface that may be presented by computer system 212 in FIG. 2. User interface 700 may be generated by video data stream process 606 and user interface process 604 in number of processes 600 in FIG. 6.

In this illustrative example, section 702 presents graphical indicator 704 for the vehicle. Additionally, section 702 presents map 706. In this example, map 706 is presented as a moving map in which graphical indicator 704 moves relative to the position of the vehicle. Section 708 presents display 710, which is a video data stream from camera 712 with the view as illustrated by line 714. In this illustrative example, other video data streams are generated in addition to the video data stream presented in display 710. In this example, the direction of travel of the vehicle along line 716 is presented to the user.

Figure 8:
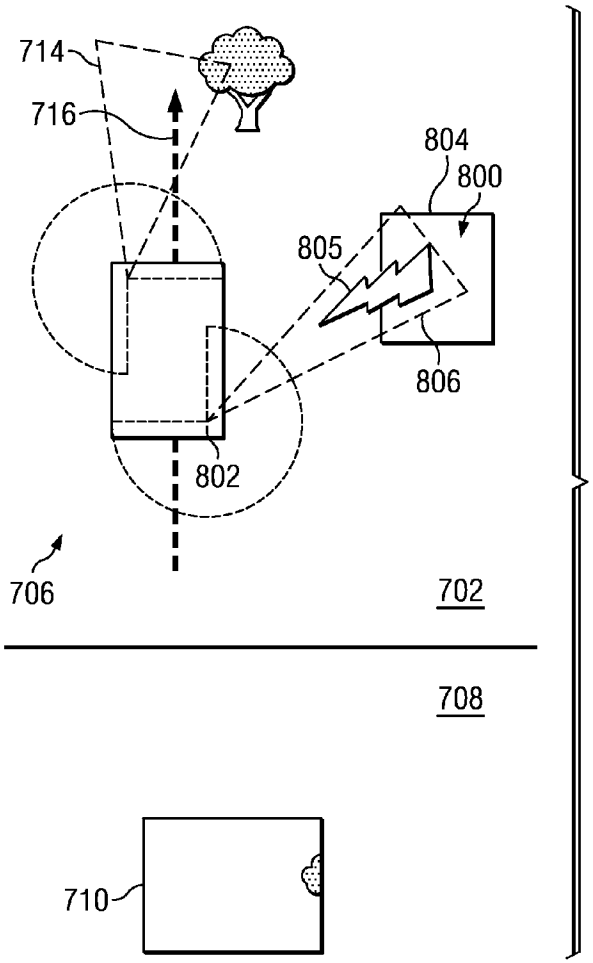
FIGS. 7-10 are illustrations of a presentation of information about events in accordance with an illustrative embodiment.

With reference now to FIG. 8, in this point in time, event 800 is detected by the event detection system for the vehicle.

In addition, camera 802 has been generating a video data stream before and after the occurrence of event 800. Graphical indicator 805 may be presented on map 706 in response to detecting event 800. In this example, event 800 occurs in building 804. Display 710 still shows the current view along line 714 in the direction of travel of the vehicle as indicated by line 716.

In the different illustrative embodiments, in response to detecting event 800, the event detection system identifies the portion of the video data stream generated by camera 802 when the event occurred. This portion of the video data stream is then presented on display 710, as depicted in FIG. 9 below.

Figure 9:
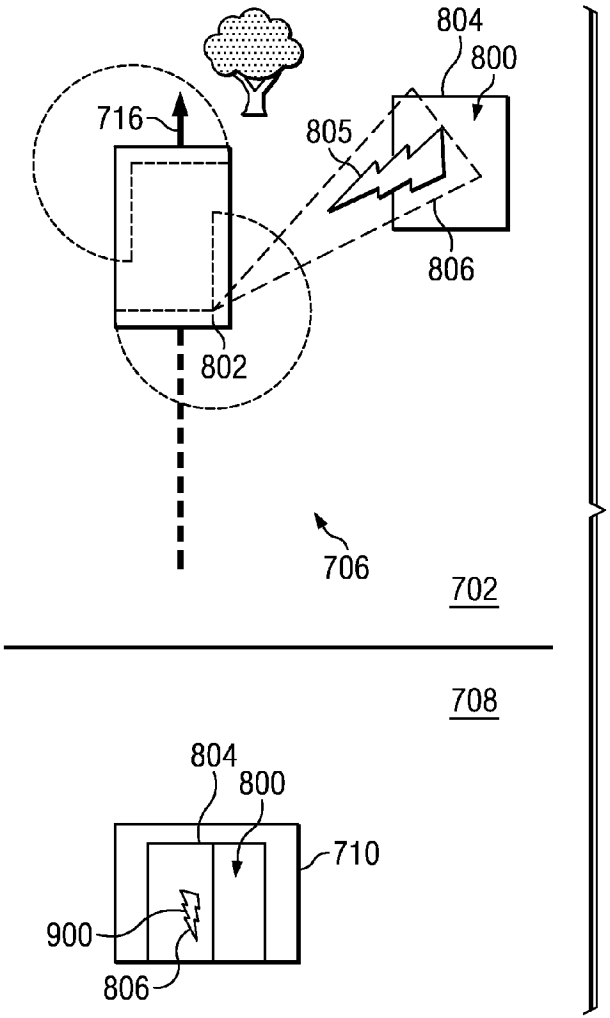

Turning now to FIG. 9, display 710 now presents the portion of the video data stream at the time of event 800 in building 804. Additionally, graphical indicator 900 indicates location 806 of event 800. In this manner, a user may review display 710 to identify the location of event 800. This visual information from the video data streams provides users more information to more quickly determine the location of the event as compared to currently used systems which do not provide the portion of the video data stream from the time of the event at the location of the event.

Figure 10:
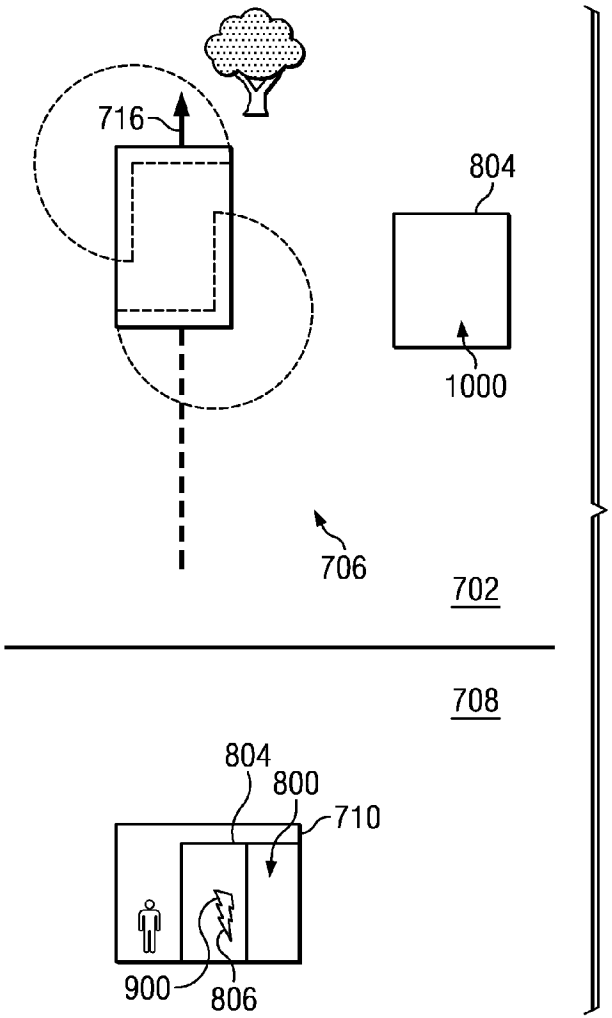

In FIG. 10, the operator has designated location 1000 on map 706. In response to this designation, display 710 now shows the portion of the video data stream from the camera corresponding to location 1000. The presentation of location 1000 in display 710 may continue until the user designates another location. In other illustrative embodiments, the user may use another pointing device, such as a keyboard or a joystick, to change the view directly in display 710 without having to provide user input to a section.

Figure 11:
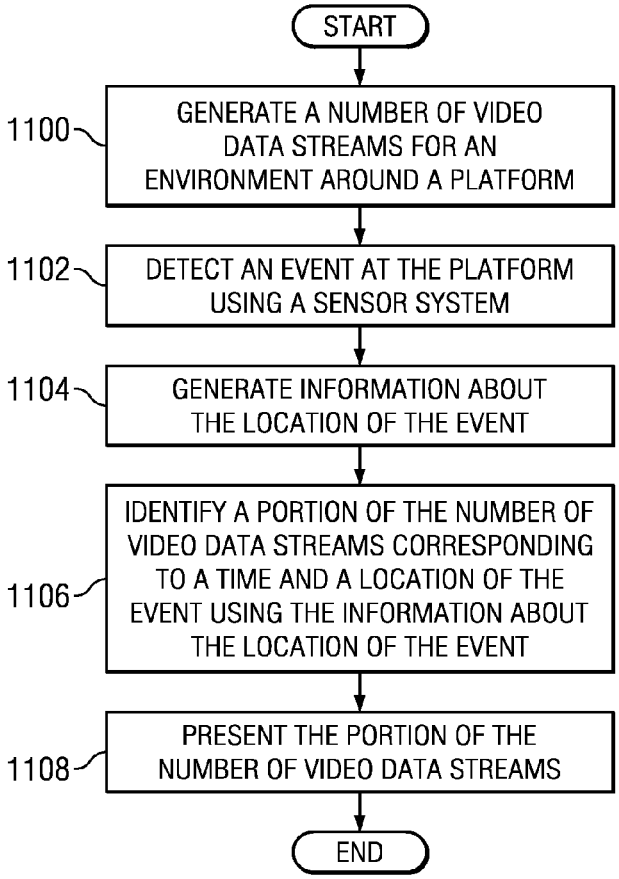
FIG. 11 is an illustration of a flowchart for detecting an event in accordance with an illustrative embodiment.

With reference now to FIG. 11, an illustration of a flowchart for detecting an event is depicted in accordance with an illustrative embodiment. The process illustrated in FIG. 11 may be implemented in event detection environment 200 in FIG. 2. In particular, the different operations may be implemented using number of processes 222 in FIG. 2.

The process begins by generating a number of video data streams for an environment around a platform (operation 1100). The number of video data streams is generated by video camera systems associated with the platform. These video data streams may cover all of the environment around the platform or a portion of the environment around the platform when generating the number of video data streams for the environment around the platform.

The process then detects an event at the platform using a sensor system (operation 1102). In these examples, the sensor system may be part of visual event detection system 202 in FIG. 2.

In response to detecting the event, information is generated about the location of the event (operation 1104). This information may include the location of the event. Additionally, the information also may include the time when the event occurred. The process identifies a portion of the number of video data streams corresponding to a time and a location of the event using the information about the location of the event (operation 1106).

The process then presents the portion of the number of video data streams (operation 1108), with the process terminating thereafter. In operation 1108, the portion is presented on a display device. The portion may include image data for the video data streams corresponding to a particular time range. This time range may be a time before, up to, and/or after the time of the event. In the presentation, number of portions of the number of video data streams is selected taking into account movement of a source of the event may be identified and presented by number of processes 222 running on computer system 212. The number of portions includes the source such that source 236 can be viewed when the number of portions is presented.

Figure 12:
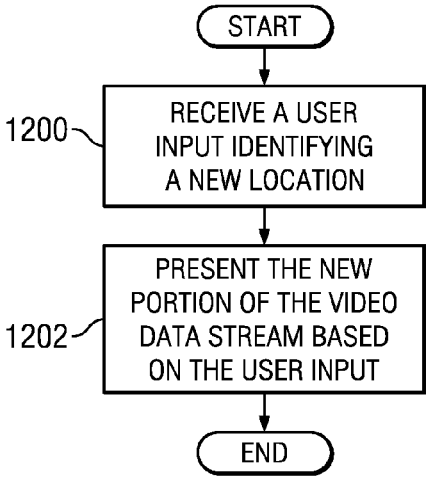
FIG. 12 is an illustration of a flowchart of a process for selecting new locations in a video data stream for presentation in accordance with an illustrative embodiment.

With reference now to FIG. 12, an illustration of a flowchart of a process for selecting new locations in a video data stream for presentation is depicted in accordance with an illustrative embodiment. The process illustrated in FIG. 12 may be implemented in event detection environment 200 in FIG. 2. The operations in FIG. 12 may be implemented using number of processes 222 in FIG. 2.

The process begins by receiving a user input identifying a new location (operation 1200). This user input identifying a new location may take a number of different forms. For example, the user may select a location on a map displayed on a display device. In other illustrative embodiments, the user may use a pointing device to change the view currently being displayed. For example, the user may pan or change the elevation of the view from the current portion being displayed.

This new location is then identified in the number of video data streams. The process then presents the new portion of the video data stream based on the user input (operation 1202), with the process terminating thereafter.

Figure 13:
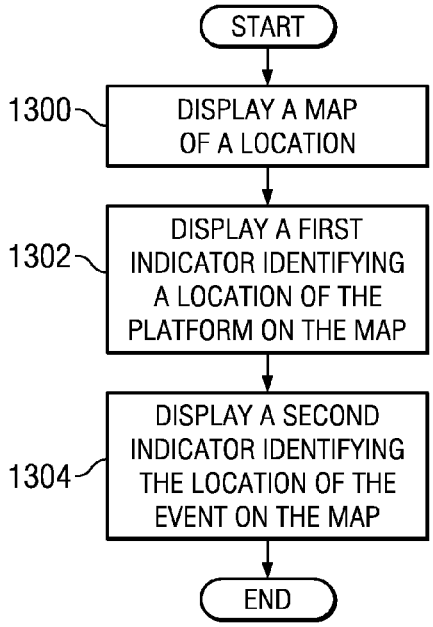
FIG. 13 is an illustration of a flowchart of a process for displaying a map of a location in accordance with an illustrative embodiment.

With reference now to FIG. 13, an illustration of a flowchart of a process for displaying a map of a location is depicted in accordance with an illustrative embodiment. The process illustrated in FIG. 13 may be implemented in event detection environment 200 in FIG. 2. The operations in FIG. 13 may be implemented using number of processes 222 in FIG. 2.

The process begins by displaying a map of a location (operation 1300). The map may be displayed on a display device. The location may be any portion of the environment around a platform with an event detection system associated with the platform. Further, the location may be the portion of the environment around the platform in which an event is detected by the event detection system. The event may be, for example, a muzzle blast, an optical flash, a projectile sound, or some other suitable event.

Thereafter, the process displays a first indicator identifying a location of the platform on the map (operation 1302). The process displays a second indicator identifying the location of the event on the map (operation 1304), with the process terminating thereafter. In these illustrative examples, the first and second indicators may be graphical indicators, such as icons, textual labels, buttons, and/or other suitable types of graphical indicators. The display of these graphical indicators and the map of the location may be presented to an operator in real-time in these examples.

The flowcharts and block diagrams in the different depicted embodiments illustrate the architecture, functionality, and operation of some possible implementations of apparatus and methods in different illustrative embodiments. In this regard, each block in the flowcharts or block diagrams may represent a module, segment, function, and/or a portion of an operation or step. In some alternative implementations, the function or functions noted in the block may occur out of the order noted in the figures.

For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

Thus, the different illustrative embodiments provide a visual event detection system that can provide a visual display of the event. In one illustrative embodiment, an apparatus comprises a video camera system, an event detection system, and a computer system. The video camera system is associated with a platform and configured to generate a number of video data streams. The event detection system is associated with the platform and configured to detect an event and generate information about the event. The computer system is associated with the platform and configured to receive the number of video data streams from the video camera system. The computer system is configured to receive the information from the event detection system. The computer system is configured to identify a portion of the number of video data streams corresponding to a time and a location of the event using the information. The computer system is also configured to present the portion of the number of video data streams.

In this manner, the identification of the location of an event can be more easily made, as compared to currently used event detection systems. Further, with one or more of the illustrative events, identifying and locating the source of the event may be more likely to occur.

The different illustrative embodiments can take the form of an entirely hardware embodiment, an entirely software embodiment, or an embodiment containing both hardware and software elements. Some embodiments are implemented in software, which includes, but is not limited to, forms, such as, for example, firmware, resident software, and microcode.

Furthermore, the different embodiments can take the form of a computer program product accessible from a computer-usable or computer-readable medium providing program code for use by or in connection with a computer or any device or system that executes instructions. For the purposes of this disclosure, a computer-usable or computer-readable medium can generally be any tangible apparatus that can contain, store, communicate, propagate, or transport the program for use by or in connection with the instruction execution system, apparatus, or device.

The computer-usable or computer-readable medium can be, for example, without limitation, an electronic, magnetic, optical, electromagnetic, infrared, or semiconductor system, or a propagation medium. Non-limiting examples of a computer-readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W), and DVD.

Further, a computer-usable or computer-readable medium may contain or store a computer-readable or usable program code such that when the computer-readable or usable program code is executed on a computer, the execution of this computer-readable or usable program code causes the computer to transmit another computer-readable or usable program code over a communications link. This communications link may use a medium that is, for example, without limitation, physical or wireless.

A data processing system suitable for storing and/or executing computer-readable or computer-usable program code will include one or more processors coupled directly or indirectly to memory elements through a communications fabric, such as a system bus. The memory elements may include local memory employed during actual execution of the program code, bulk storage, and cache memories, which provide temporary storage of at least some computer-readable or computer-usable program code to reduce the number of times code may be retrieved from bulk storage during execution of the code.

Input/output or I/O devices can be coupled to the system either directly or through intervening I/O controllers. These devices may include, for example, without limitation, keyboards, touch screen displays, and pointing devices. Different communications adapters may also be coupled to the system to enable the data processing system to become coupled to other data processing systems or remote printers or storage devices through intervening private or public networks. Non-limiting examples are modems and network adapters and are just a few of the currently available types of communications adapters.

The description of the different illustrative embodiments has been presented for purposes of illustration and description, and it is not intended to be exhaustive or limited to the embodiments in the form disclosed. Many modifications and variations will be apparent to those of ordinary skill in the art. Further, different illustrative embodiments may provide different advantages as compared to other illustrative embodiments. For example, although the different illustrative embodiments have been described with respect to a platform in the form of a vehicle, the different illustrative embodiments may be used with other types of platforms. For example, without limitation, the platform may be a mobile platform, a stationary platform, a land-based structure, an aquatic-based structure, an aircraft, a surface ship, a tank, a personnel carrier, a train, an automobile, a manufacturing facility, a building, and/or other suitable types of platforms.

The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a video camera system configured for association with a platform and configured to generate a number of video data streams;

an event detection system configured for association with the platform and configured to detect an event and generate information about the event; and a computer system configured to receive the number of video data streams from the video camera system; receive the information from the event detection system; identify a portion of the number of video data streams corresponding to a time and a location of the event using the information; present the portion of the number of video data streams; receive user input identifying a new location relative to a first location of the event; identify the new location in the portion of the number of video data streams; change the portion of the number of video data streams to show the new location and to form a new portion; and present the new portion.

2. The apparatus of claim 1, wherein the event detection system comprises at least one of a plurality of acoustic sensors, a plurality of optical sensors, and a plurality of radiofrequency sensors.

3. The apparatus of claim 2, wherein the event detection system further comprises:

a processor unit connected to at least one of the plurality of acoustic sensors, the plurality of optical sensors, and the plurality of radiofrequency sensors and configured to identify the time and the location of the event.

4. The apparatus of claim 2, wherein the plurality of acoustics sensors generates signals to form the information.

5. The apparatus of claim 1, wherein the computer system is configured to display a map and present a graphical indicator indicating the location of the event relative to the platform.

6. The apparatus of claim 5, wherein the graphical indicator is a first graphical indicator and wherein the computer system is configured to display a second graphical indicator on the map indicating the platform.

7. The apparatus of claim 1, wherein the platform is a mobile platform and wherein the computer system is configured to identify portions of the number of video data streams corresponding to the location taking into account movement of the platform.

8. The apparatus of claim 1, wherein the computer system is configured to identify a number of portions of the number of video data streams taking into account movement of a source of the event such that the source is within the number of portions.

9. The apparatus of claim 1, wherein the video camera system is configured to generate a plurality of video data streams from at least one of about 0 degrees to about 360 degrees and about 0 steradians to about 4 pi steradians relative to the platform.

10. The apparatus of claim 1, wherein the event is selected from a group comprising one of a gunshot, an explosion, and a voice.

11. The apparatus of claim 1 further comprising:

the platform, wherein the video camera system, the event detection system, and the computer system are associated with the platform.

12. The apparatus of claim 1, wherein the platform is selected from a group comprising one of a mobile platform, a stationary platform, a land-based structure, an aquatic-based structure, a vehicle, an aircraft, a surface ship, a tank, a personnel carrier, a train, an automobile, a manufacturing facility, and a building.

13. The apparatus of claim 1 wherein the computer system is further configured to receive the user input in a form of panning or changing an elevation of a view of the number of video data streams.

14. The apparatus of claim 1 wherein the program code for receiving user input further comprises program code for receiving the user input in a form of panning or changing an elevation of a view of the number of video data streams.

15. A method for detecting an event, the method comprising:

generating a number of video data streams for an environment around a platform, wherein the number of video data streams is received from a video camera system associated with the platform;

detecting the event at the platform using a sensor system;

responsive to detecting the event, generating information about a location of the event;

identifying, by a computer system, a portion of the number of video data streams corresponding to a time and the location of the event using the information about the location of the event;

presenting, by the computer system, the portion of the number of video data streams;

receiving, at the computer system, user input identifying a new location relative to a first location of the event;

identifying, by the computer system, the new location in the portion of the number of video data streams;

changing, by the computer system, the portion of the number of video data streams to show the new location and to form a new portion; and presenting, by the computer system, the new portion.

16. The method of claim 15 further comprising:

displaying a graphical indicator in the portion of the number of video data streams at the location of the event.

17. The method of claim 15 further comprising:

displaying a map of the location;

displaying a first indicator identifying a location of the platform on the map; and displaying a second indicator identifying the location of the event on the map.

18. The method of claim 15, wherein an event detection system comprises a processor unit and at least one of a plurality of acoustic sensors, a plurality of optical sensors, and a plurality of radiofrequency sensors, wherein the processor unit is connected to the at least one of the plurality of acoustic sensors, the plurality of optical sensors, and the plurality of radiofrequency sensors and configured to identify the time and the location of the event.

19. The method of claim 15, wherein the platform is a mobile platform and wherein the computer system is configured to identify portions of the number of video data streams corresponding to the location taking into account movement of the platform.

20. The method of claim 15, wherein the video camera system is configured to generate a plurality of video data streams from at least one of about 0 degrees to about 360 degrees and about 0 steradians to about 4 pi steradians relative to the platform.

21. The method of claim 15 further comprising:

identifying a number of portions of the number of video data streams taking into account movement of a source of the event such that the source is within the number of portions.

22. The method of claim 21 further comprising:

presenting the number of portions of the number of video data streams.

23. The method of claim 15 wherein receiving the user input further comprises receiving the user input in a form of panning or changing an elevation of a view of the number of video data streams.

24. A computer program product for detecting an event, the computer program product comprising:

a computer readable storage medium;

program code, stored on the computer readable storage medium, for generating a number of video data streams for an environment around a platform, wherein the number of video data streams is received from a video camera system associated with the platform;

program code, stored on the computer readable storage medium, for detecting the event at the platform using a sensor system;

program code, stored on the computer readable storage medium, responsive to detecting the event, for generating information about a location of the event;

program code, stored on the computer readable storage medium, for identifying, by a computer system, a portion of the number of video data streams corresponding to a time and the location of the event using the information about the location of the event; and program code, stored on the computer readable storage medium, for presenting, by the computer system, the portion of the number of video data streams;

program code, stored on the computer readable storage medium, for receiving, at the computer system, user input identifying a new location relative to a first location of the event;

program code, stored on the computer readable storage medium, for identifying, by the computer system, the new location in the portion of the number of video data streams;

program code, stored on the computer readable storage medium, for changing, by the computer system, the portion of the number of video data streams to show the new location and to form a new portion; and program code, stored on the computer readable storage medium, for presenting, by the computer system, the new portion.

25. The computer program product of claim 24 further comprising:

program code, stored on the computer readable storage medium, for displaying a graphical indicator in the portion of the number of video data streams at the location of the event.

26. The computer program product of claim 24 further comprising:

program code, stored on the computer readable storage medium, for displaying a map of the location;

program code, stored on the computer readable storage medium, for displaying a first indicator identifying a location of the platform on the map; and program code, stored on the computer readable storage medium, for displaying a second indicator identifying the location of the event on the map.

* * * * *